US008491350B2

(12) United States Patent
Al-Sharif et al.

(10) Patent No.: US 8,491,350 B2
(45) Date of Patent: Jul. 23, 2013

(54) FLOATING PRODUCTION UNIT WITH DISCONNECTABLE TRANSFER SYSTEM

(75) Inventors: Majid Al-Sharif, Houston, TX (US); Tony A. Owen, Carthage, MS (US)

(73) Assignee: Helix Energy Solutions Group, Inc., Houston, TX (US)

( * ) Notice: Subject to any disclaimer, the term of this patent is extended or adjusted under 35 U.S.C. 154(b) by 380 days.

(21) Appl. No.: 12/914,743

(22) Filed: Oct. 28, 2010

(65) Prior Publication Data

US 2011/0294380 A1 Dec. 1, 2011

Related U.S. Application Data

(60) Provisional application No. 61/349,063, filed on May 27, 2010, provisional application No. 61/357,615, filed on Jun. 23, 2010.

(51) Int. Cl.
*B63B 35/44* (2006.01)

(52) U.S. Cl.
USPC ..... 441/5; 114/230.12

(58) Field of Classification Search
USPC ..... 114/230.12; 441/4, 5
See application file for complete search history.

(56) References Cited

U.S. PATENT DOCUMENTS

| | | | | |
|---|---|---|---|---|
| 4,765,378 | A | 8/1988 | Engelskirchen et al. | |
| 5,178,087 | A * | 1/1993 | O'nion et al. | 114/230.12 |
| 5,941,746 | A | 8/1999 | Isnard et al. | |
| 6,176,193 | B1 | 1/2001 | Whitby et al. | |
| 2003/0159581 | A1 | 8/2003 | Sanderford et al. | |
| 2005/0163572 | A1 | 7/2005 | Keron | |
| 2007/0155259 | A1 | 7/2007 | Van Tol et al. | |
| 2008/0096448 | A1 | 4/2008 | Lokken et al. | |
| 2008/0311804 | A1 | 12/2008 | Bauduin et al. | |
| 2009/0126616 | A1 | 5/2009 | Srinivasan | |
| 2011/0061582 | A1 * | 3/2011 | Braud et al. | 114/293 |

OTHER PUBLICATIONS

International Search Report for International Patent Application No. PCT/US2011/036081; dated Jan. 18, 2012, Korean Intellectual Patent Office.

Written Opinion for International Patent Application No. PCT/US2011/036081; dated Jan. 18, 2012, Korean Intellectual Patent Office.

* cited by examiner

*Primary Examiner* — Edwin Swinehart
(74) *Attorney, Agent, or Firm* — Locke Lord LLP

(57) ABSTRACT

An offshore production system comprising a floating production unit, a production buoy, and a modular production transfer system therebetween. The modular production transfer system may include a support structure configured to be secured to an exterior side of the floating production unit, a moon pool secured outboard of the support structure, an inspection platform secured above the moon pool, a turntable secured to the inspection platform. The modular production transfer system may be configured to mate with the buoy connector and rotate within the moon pool, thereby maintain the buoy in a fixed orientation, while the floating production unit rotates about the buoy, during production.

17 Claims, 16 Drawing Sheets

FLOATING PRODUCTION UNIT WITH DISCONNECTABLE TRANSFER SYSTEM

CROSS REFERENCE TO RELATED APPLICATIONS

This application claims priority benefit of Application Ser. No. 61/349,063, filed May 27, 2010 and entitled "Floating Production Unit with Disconnectable Transfer System", and Application Ser. No. 61/357,615, filed Jun. 23, 2010 and entitled "Floating Production Unit with Disconnectable Transfer System", both of which are incorporated herein by specific reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to floating production units; and more specifically relate to a floating production unit with disconnectable transfer system.

2. Description of the Related Art

U.S. Patent Application No. 20090126616 discloses an "offshore floating production, storage, and off-loading vessel has a monolithic non ship-shaped hull of polygonal configuration surrounding a central double tapered conical moon pool and contains water ballast and oil storage compartments. The exterior side walls of the hull have flat surfaces and sharp corners to cut ice sheets, resist and break ice, and move ice pressure ridges away from the structure. An adjustable water ballast system induces heave, roll, pitch and surge motions of the vessel to dynamically position and maneuver the vessel to accomplish ice cutting, breaking and moving operations. The moon pool shape and other devices on the vessel provide added virtual mass capable of increasing the natural period of the roll and heave modes, reducing dynamic amplification and resonance due to waves and vessel motion, and facilitate maneuvering the vessel. The vessel may be moored by a disconnectable turret buoy received in a support frame at the bottom of the moon pool and to which flexible well risers and mooring lines are connected."

U.S. Patent Application No. 20080311804 discloses a "system is described for use at offshore locations of large depth, for mooring a production vessel or floating unit (14) at a location over a hydrocarbon reservoir (26) and for connecting risers (101) that can be carrying hydrocarbons up from the sea floor to a production vessel that stores the hydrocarbons, flowlines for water injection, gas lift, gas export, umbilicals and mooring lines that moor the vessel. Both the mooring lines and the risers are disconnectably connected to the vessel though a connection buoy, or connector (16). The invention concerns a system that allows a connector (16) to be used that is of minimum mass and volume, to ease its handling especially during its connection and disconnection to and from a vessel."

U.S. Patent Application No. 20080096448 discloses a "combined riser, offloading and mooring system is provided for the offloading of hydrocarbons from a floating production vessel (FPV), onto a tanker. The system preferably includes an offloading buoy tethered to the mudline by at least one mooring line. The offloading buoy and the mooring line can be part of an offloading buoy system for supporting a production riser and fluid jumper lines. Additionally, the offloading buoy system can support an offloading jumper line from the FPV to a fluid connector on the offloading buoy system through which hydrocarbon fluid is loaded via an offloading hose onto a tanker. The combined riser, offloading and mooring system also preferably includes at least one set of FPV mooring lines for securing the floating production vessel to the offloading buoy system. The system further preferably includes a hawser line for connecting the tanker to the offloading buoy system. In this manner, the number of mooring lines for the floating production vessel may be reduced."

U.S. Patent Application No. 20050163572 discloses an "arrangement for the storage of marketable quantities of crude oil at a semi-submersible floating production vessel. The storage is achieved by hanging a segmented reinforced concrete tank to the underside of the semi-submersible vessel. The semi-submersible vessel can be an existing semi-submersible drilling rig. By maintaining the mass of the tank and contents slightly greater than the displacement of the tank and by arranging the centre of gravity of the tank below its centre of buoyancy, the metacentric height of the semi-submersible vessel is approved. The storage arrangement for the oil provides the necessary maintenance of mass by either storing approximately 4/5 of the oil in oil-over-water chambers and approximately 1/5 in gas-over-oil chambers or by using a gas-over-oil-over-water arrangement in all the chambers. The piping arrangements minimize the free surface of liquids in the tank."

U.S. Patent Application No. 20030159581 discloses a "method and system for sea-based handling/treatment of fluid hydrocarbons (oil) with associated gas comprise a first separation step in a high-pressure separator (18) installed on the sea bed, from which is output an oil flow containing an essentially predefined percentage of residual gas. The oil containing residual gas is carried through a riser (22) up to a surface vessel/production ship (12), where it is subjected to a second separation step in a second separator (24) incorporated in a low-pressure surface plant on board the vessel (12), this separated residual gas being used as fuel for direct/indirect generation of electric power for the operation of the underwater and above-water sections of the system. Water and gas produced in the first separation step is returned to a suitable reservoir by the use of a multiphase pump."

The inventions disclosed and taught herein are directed to an improved system for floating production units and disconnectable transfer systems.

BRIEF SUMMARY OF THE INVENTION

An offshore production system comprising a floating production unit, a production buoy, and a modular production transfer system therebetween. The floating production unit may include an ocean-going dynamically positioned ship. In some cases, the floating production unit may include two sponsons, one secured to either side of the ship and each containing at least one tank, at least a portion of an outboard sidewall of one of the sponsons being reinforced. The floating production unit preferably includes production equipment secured atop the ship and sponsons, the production equipment may be configured to separate gas and liquid from raw hydrocarbon production.

The production buoy may include at least one production riser configured to transfer the raw hydrocarbon production to the floating production unit, at least one gas export riser configured to transfer gas from the floating production unit, at least one liquid export riser configured to transfer liquid from the floating production unit, and a buoy connector rigidly secured to and in fluid communication with the risers.

The modular production transfer system may include a support structure configured to be secured to an exterior side of the reinforced outboard sidewall. The modular production transfer system may also include a moon pool secured outboard of the support structure. The modular production transfer system may also include a inspection platform secured above the moon pool. The modular production transfer system may also include a turntable secured to the inspection platform. The modular production transfer system may also include a winch secured to the turntable. The modular production transfer system may also include a shipboard connector positioned below the turntable. The shipboard connector may be configured to mate with the buoy connector and rotate within the moon pool, thereby maintain the buoy in a fixed orientation, while the floating production unit rotates about the buoy, during production.

The modular production transfer system may also include a swivel stalk on a turn table rigidly secured to the shipboard connector and having a plurality of swivel joints. The floating production unit preferably includes production piping rigidly secured to and in fluid communication with the swivel joints and production equipment aboard the floating production unit.

The moon pool may be configured to contain the buoy such that the buoy connector is above the water during production. The support structure may be configured to be secured to an exterior side of the floating production unit while the floating production unit is listing, such as when the tank on the opposite side of the reinforced outboard sidewall. In this manner the modular production transfer system may be installed on and/or removed from the floating production unit without requiring a dry dock or divers.

DETAILED DESCRIPTION OF THE INVENTION

Figure 1:
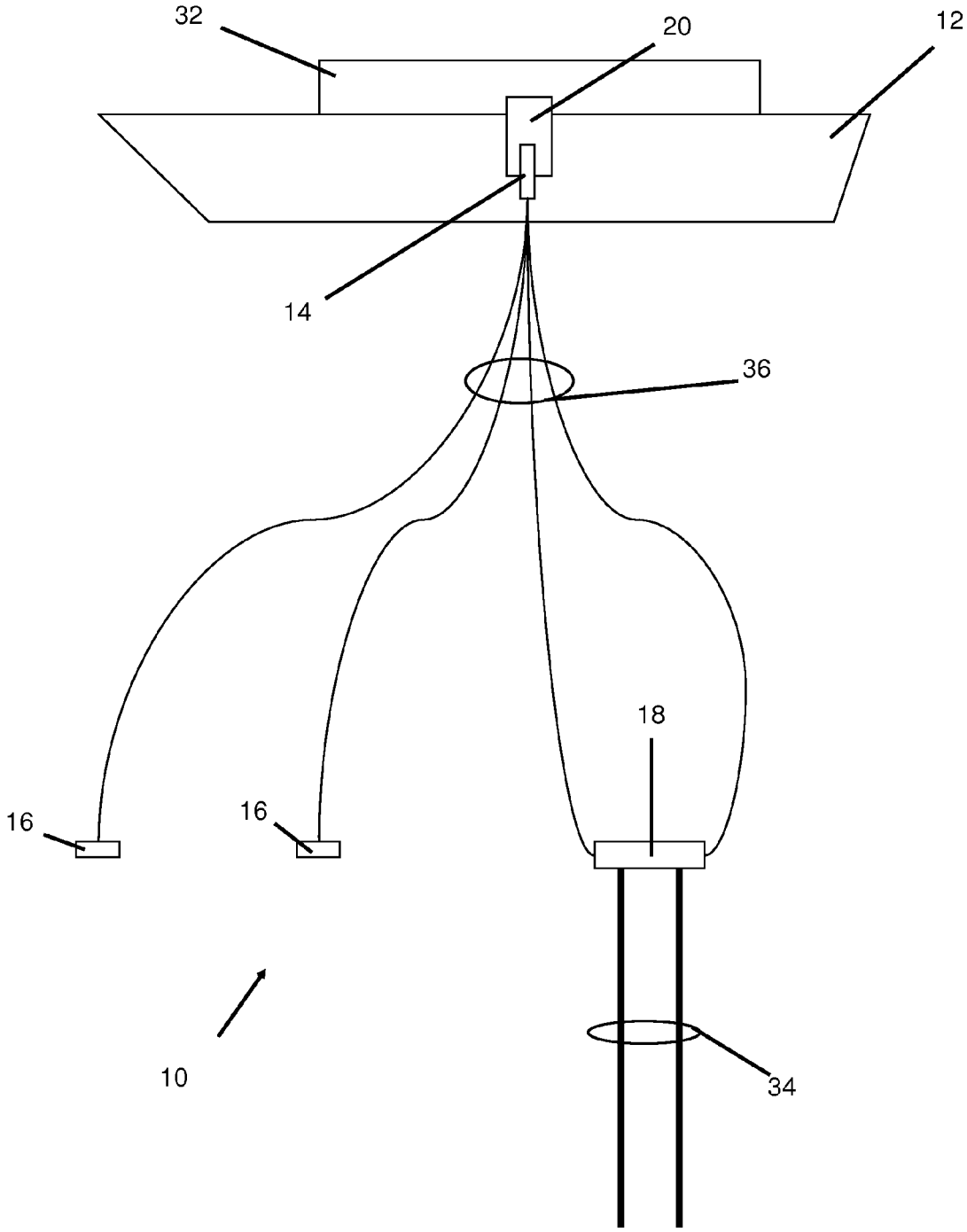
FIG. 1 illustrates a simplified block diagram of a particular embodiment of an offshore production system comprising a floating production unit, a production buoy, and a modular production transfer system utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created an offshore production system comprising a floating production unit, a production buoy, and a modular production transfer system therebetween. The floating production unit may include an ocean-going dynamically positioned ship. In some cases, the floating production unit may include two sponsons, one secured to either side of the ship and each containing at least one tank, at least a portion of an outboard sidewall of one of the sponsons being reinforced. The floating production unit preferably includes production equipment secured atop the ship and sponsons, the production equipment configured to separate gas and liquid from raw hydrocarbon production.

The production buoy may include at least one production riser configured to transfer the raw hydrocarbon production to the floating production unit, at least one gas export riser configured to transfer gas from the floating production unit, at least one liquid export riser configured to transfer liquid from the floating production unit, and a buoy connector rigidly secured to and in fluid communication with the risers.

The modular production transfer system may include a support structure configured to be secured to an exterior side of the reinforced outboard sidewall. The modular production transfer system may also include a moon pool secured outboard of the support structure. The modular production transfer system may also include a inspection platform secured above the moon pool. The modular production transfer system may also include a turntable secured to the inspection platform. The modular production transfer system may also include a winch secured to the turntable. The modular production transfer system may also include a shipboard connector positioned below the turntable. The shipboard connector may be configured to mate with the buoy connector and rotate within the moon pool, thereby maintain the buoy in a fixed orientation, while the floating production unit rotates about the buoy, during production.

The modular production transfer system may also include a swivel stalk on a turn table rigidly secured to the shipboard connector and having a plurality of swivel joints. The floating production unit preferably includes production piping rigidly secured to and in fluid communication with the swivel joints and production equipment aboard the floating production unit.

The moon pool may be configured to contain the buoy such that the buoy connector is above the water during production. The support structure may be configured to be secured to an exterior side of the floating production unit while the floating production unit is listing, such as when the tank on the opposite side of the reinforced outboard sidewall. In this manner the modular production transfer system may be installed on and/or removed from the floating production unit without requiring a dry dock or divers.

Figure 2:
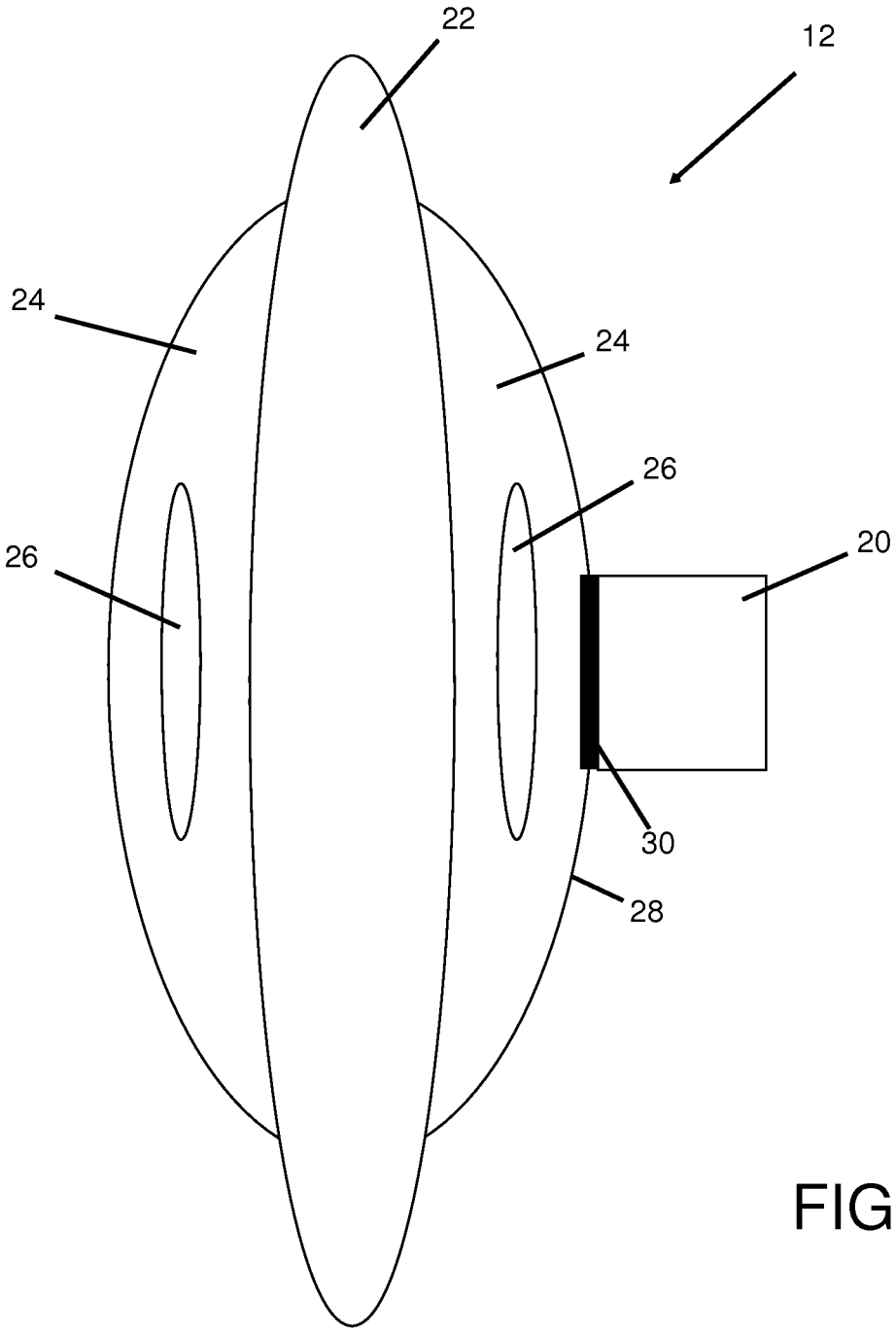
FIG. 2 illustrates a simplified block diagram of a particular embodiment of the floating production unit of FIG. 1.

FIG. 1 is an illustration of an offshore production system 10 comprising a floating production unit (FPU) 12, a production buoy 14 in fluid communication with one or more wells 16 an one or more pipeline stations 18, and a modular production transfer system 20 therebetween. Also referring to FIG. 2, the FPU 12 may include an ocean-going dynamically positioned vessel or ship 22. In some cases, the floating production unit 12 may include two sponsons 24, with one sponson 24 secured to either side of the ship 22. The sponsons 24 each preferably contain at least one tank 26. An outboard sidewall 28 of one of the sponsons 24 preferably includes reinforcement 30 to support the modular production transfer system 20. The floating production unit 12 also preferably includes production equipment 32 secured atop the ship 22 and/or sponsons 24. The production equipment 32 is preferably configured to separate and/or meter gas and liquid from raw hydrocarbon production received from the wells 16 through the buoy 14 and modular production transfer system 20. The gas and liquid is then transferred to one or more pipelines 34 through the modular production transfer system 20, buoy 14, risers 36, and pipeline station 18.

In one specific embodiment, the FPU 12 is a converted ice-class ocean going ferry. The FPU 12 may also be purpose built or a converted from an oil tanker or general purpose vessel. In this specific embodiment, the conversion includes upgrading the FPU 12 with seven 12-megawatt electric thrusters and dual 4,000-pound hydraulic thrusters for dynamic-positioning capability, installing new living quarters, and adding full-length ten meter wide sponsons 24 on each side of the FPU 12 for additional deck space and payload capacity to accommodate the production equipment 32 and modular production transfer system 20 to service the wells 16. In this specific embodiment, the FPU 12 is approximately 528-foot long.

Figure 3:
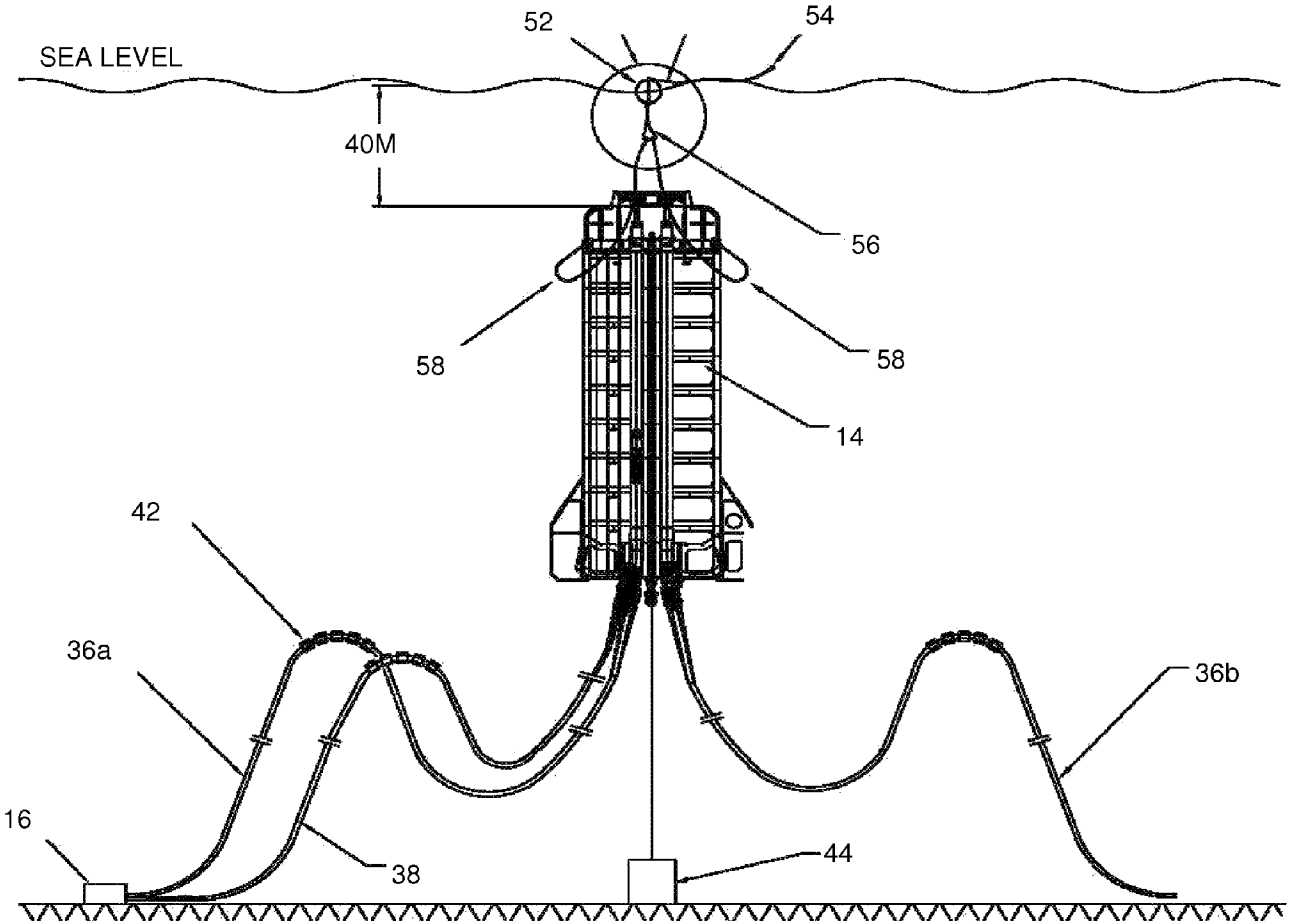
FIG. 3 illustrates a simplified diagram of a particular embodiment of the production buoy of FIG. 1.
Figure 4:
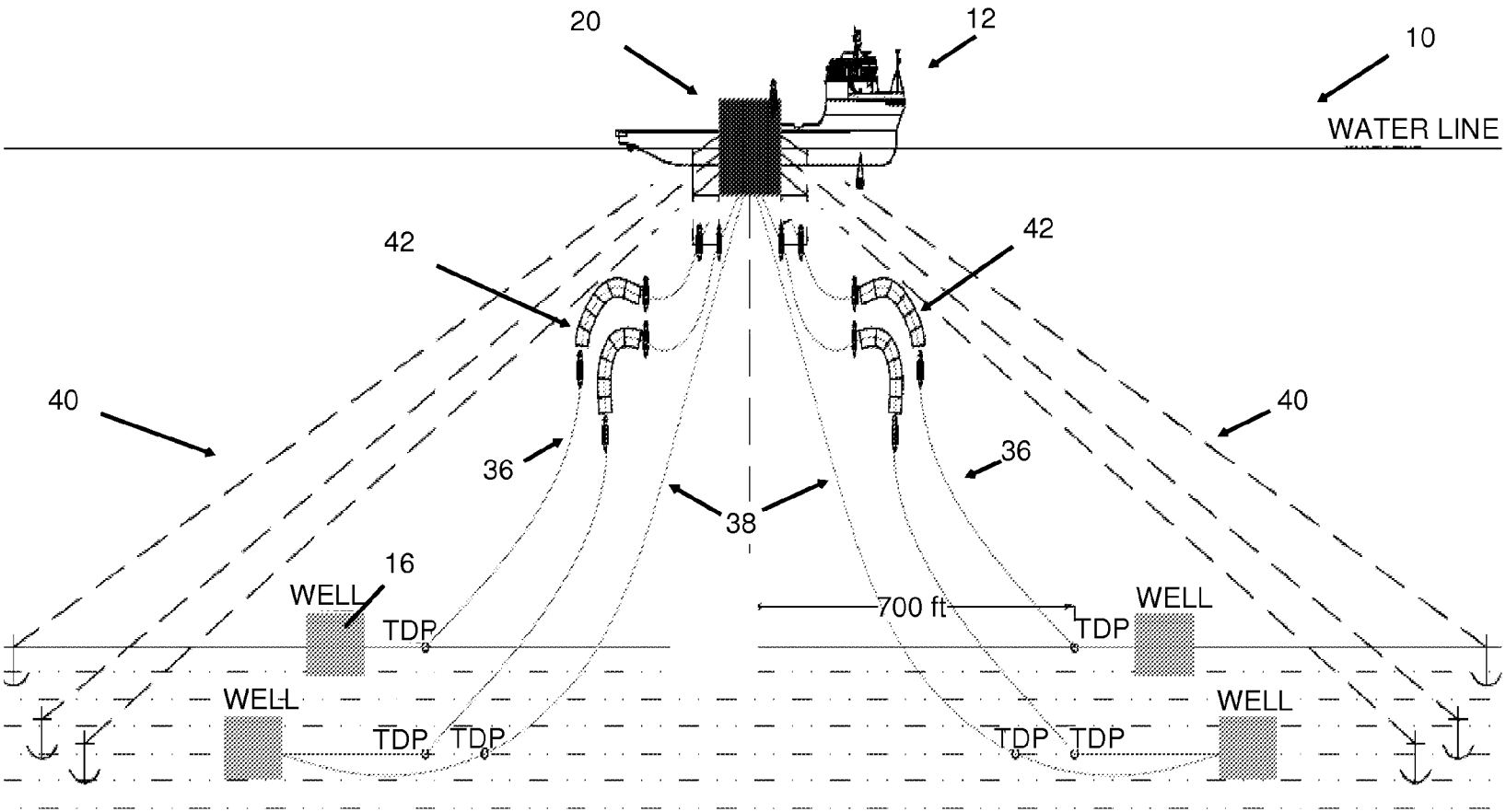
FIG. 4 illustrates another simplified diagram of a particular embodiment of the offshore production system utilizing certain aspects of the present inventions.

Referring also to FIGS. 3 and 4, the buoy 14 may consist of a number of compartments and could be fabricated either via plate construction or using parallel API pipe joints and subdividing the joints into compartments. The buoy 14 may be connected, using a remotely operated Vehicle (ROV) for example, to one or more risers 36, umbilical cables/hoses/lines 38, moorings 40, and a mooring monitoring system that may be installed on the risers 36, umbilical cables 38, and/or moorings 40 in order to facilitate overall system operation and ensure riser integrity.

The risers 36 preferably include one or more production risers 36*a* connected to the well(s) 16 for receiving the raw hydrocarbon production. The risers also preferably include one or more export risers 36*b* for transferring the separated and/or metered gas and liquid to the one or more pipelines 34. The risers 36, umbilical cables 38, and/or moorings 40 may include floats 42 to provide buoyancy to the risers 36, thereby causing the risers 36, umbilical cables 38, and/or moorings 40 to form a lazy wave configuration with multiple catenary.

Figure 5:
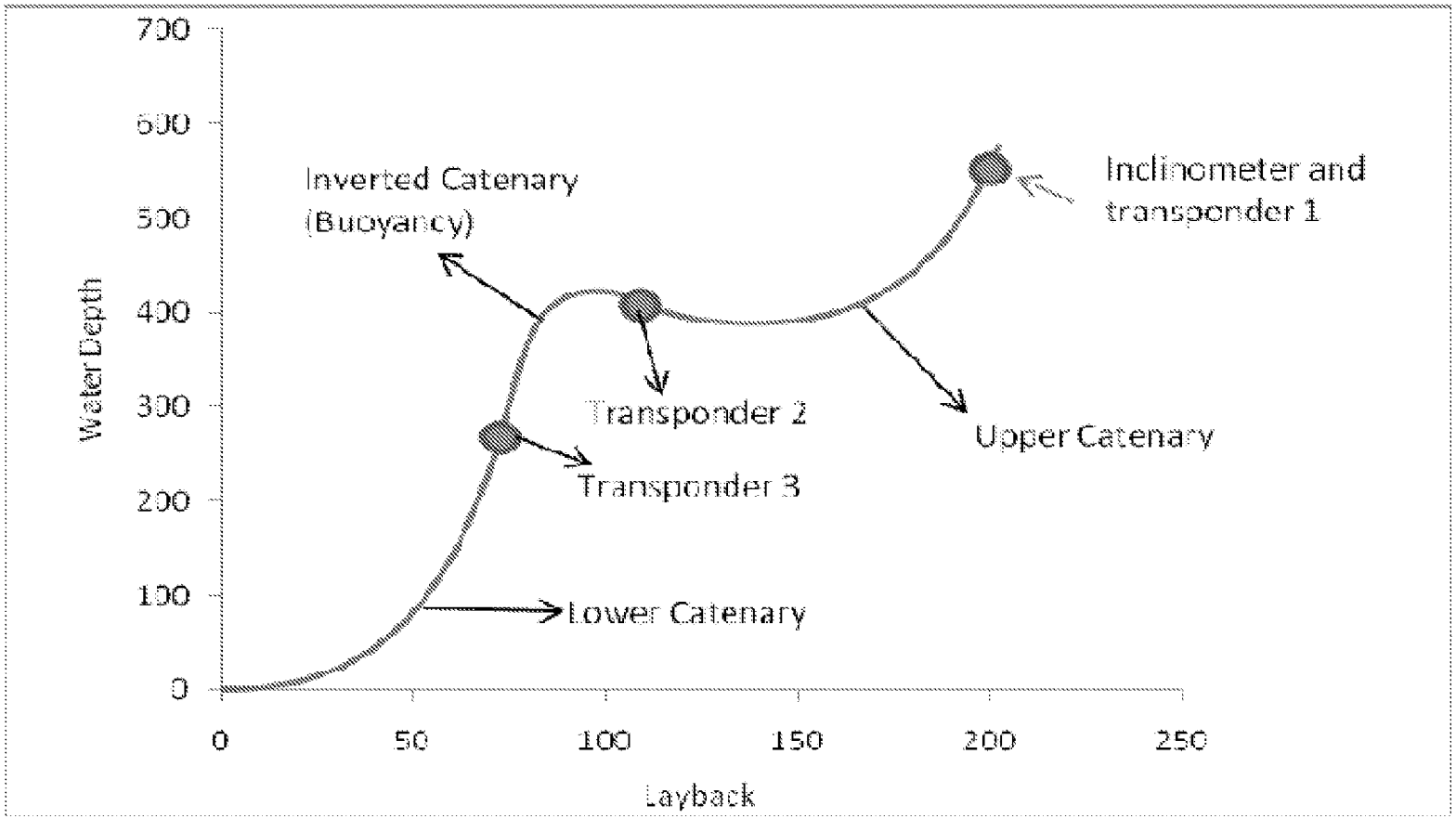
FIG. 5 illustrates a chart of a lazy wave configuration with multiple catenary that may be formed by flexible risers utilizing certain aspects of the present inventions.
Figure 6:
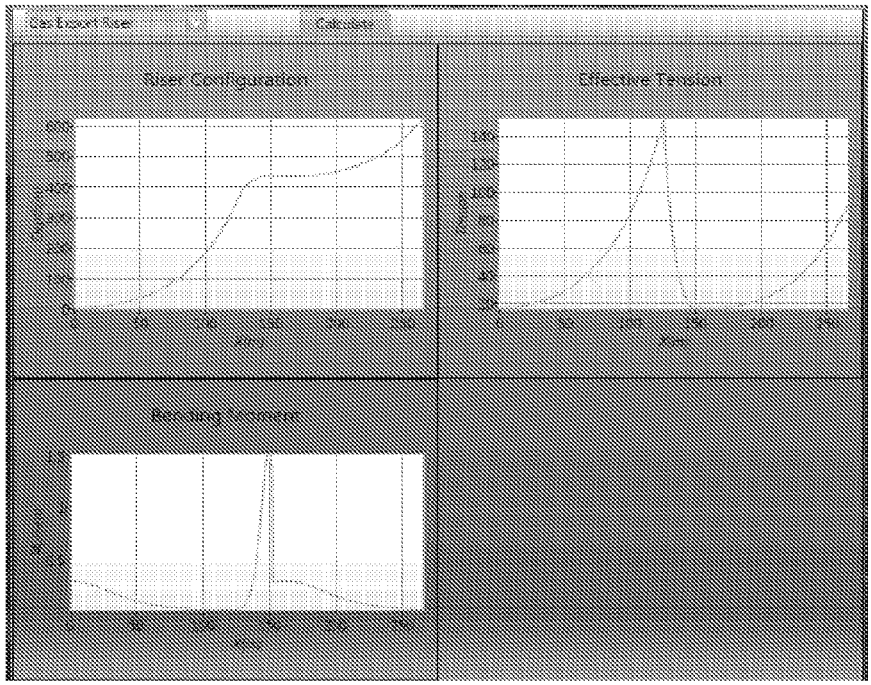
FIG. 6 illustrates a chart forces that may be experienced by flexible risers at given locations.
Figure 7:
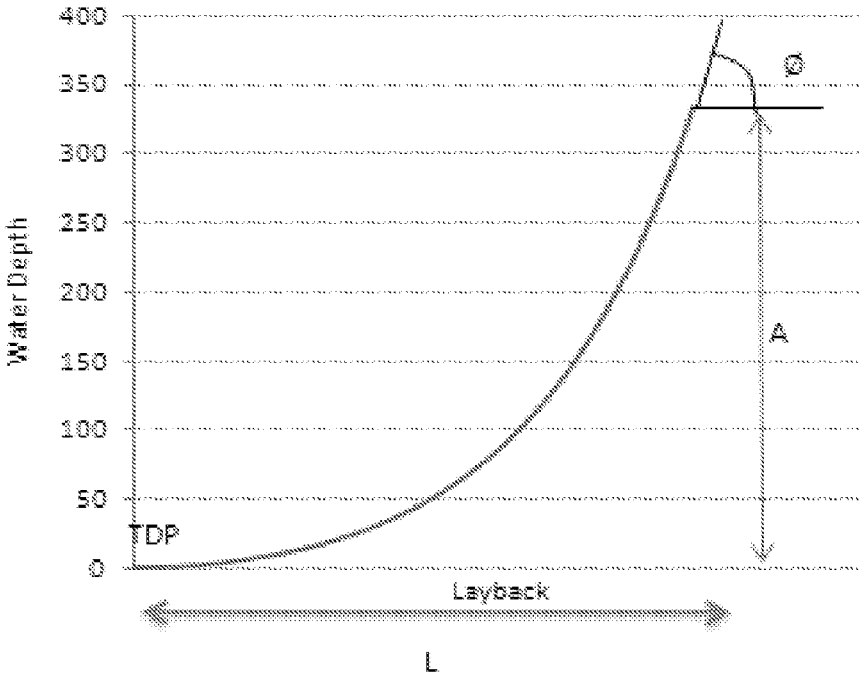
FIG. 7 illustrates a chart of a single catenary configuration that may be formed by flexible risers utilizing certain aspects of the present inventions.

The umbilical cables 38 may include electrical cables and/or hydraulic lines for control and monitoring of the wells 16 and/or pipelines 34. The moorings 40 are intended for positioning the buoy 14 when disconnected. While the moorings 40 may in some cases, the moorings 40 are not intended for positioning the FPU 12, in a preferred embodiment. As shown in FIG. 5, the umbilical cables 38 may also connect to sensors, transponders, transmitters, and/or inclinometers 44 secured to the risers 36, umbilical cables 38, and/or moorings 40, as part of the mooring monitoring system. As shown in FIG. 6, tension and bending moment of the risers 36, umbilical cables 38, and/or moorings 40 may be calculated utilizing coordinates, angles, and/or other readings from the sensors, transponders, transmitters, and/or inclinometers 44. If the weight of the risers 36, umbilical cables 38, and/or moorings 40 is not a limiting factor, the risers 36, umbilical cables 38, and/or moorings 40 need not include the floats 42, and they would then be expected to form a single simple catenary, as shown in FIG. 7.

In any case, the buoy 14 preferably includes internal floatation, which may be provided by the compartments described above. More specifically, in one specific embodiment, the buoy 14 may include six symmetrically places ballast tanks. These tanks allow for flexibility in a ballasting program, by providing the ability to trim the vertical attitude of the buoy 14 to compensate for differences in a calculated and actual hang off weight of the risers 36, umbilical cables 38, and/or moorings 40.

Figure 8:
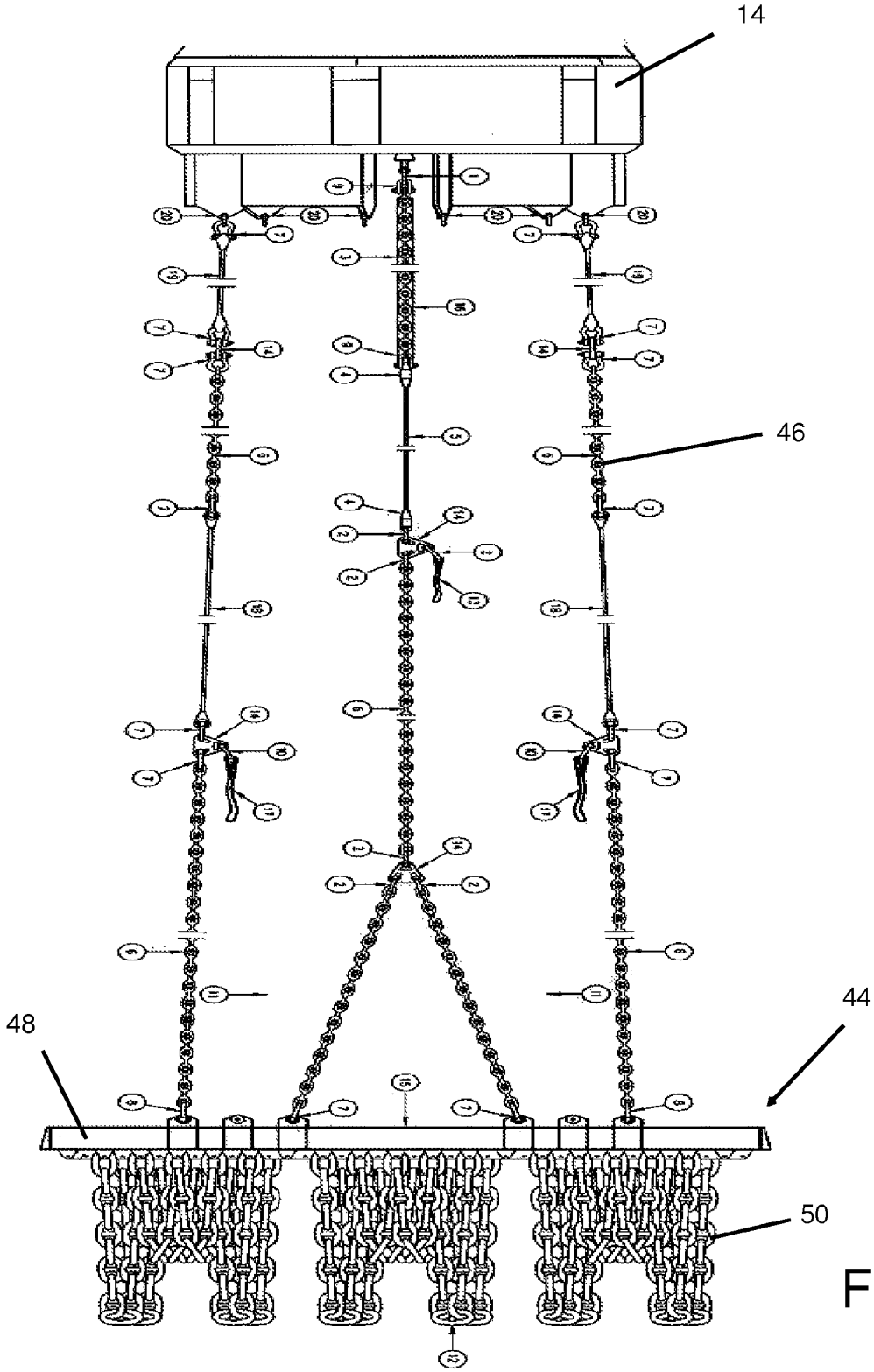
FIG. 8 illustrates a particular embodiment of a weighting system utilizing certain aspects of the present inventions.

As best shown in FIG. 8, a clump weight 44 is preferably hung below the buoy 14. The clump weight 44 may be suspended under the buoy 14 by chains 46, rope, such as polyester rope, or some combination. In a preferred embodiment, the clump weight 44 comprises a plate 48 and a series of chains 50 hanging below the plate 48. As the buoy 14 descends, each link in the chains 50 hanging below the plate 48 sequentially contacts the seabed, thereby releasing their weight from the clump weight 44 and buoy 14 and slowing the buoy's 14 decent. This provides for a soft landing for the buoy 14, risers 36, umbilical cables 38, and/or moorings 40, after disconnection.

In one specific embodiment, the buoy 14 has 147.26 metric ton, or tonne, (Te) net buoyancy. The chains 50 of the clump weight 44 weigh approximately 108.84, thereby reducing the net buoyancy to 38.42 Te of positive buoyancy. The plate 48 of the clump weight 44 weighs approximately 63.6 Te. Thus, the 38.42 Te of positive buoyancy reacts against the 63.6 Te permanent clump weight 44. This then requires environmental or incidental loads of 25.18 Te to overcome the mass of the clump weight 44. A clump weight 44 coefficient of friction adds an additional 19.1 Te to clump weight 44 on bottom stability. The worst case 100 Year Loop Current t 3.2 knots adds only 14.7 Te in drag coefficient to overcome an inertial 44.28 Te of clump weight 44 mass and friction. Of course, this embodiment is not intended to be limiting, but rather provide an example and explain the calculations that go into design of the clump weight 44.

The chains 46, and/or rope, securing the clump weight 44 to the buoy 14 are preferably sized to hold the buoy 14 approximately 40 meters, or 130 feet, below the surface of the water, when disconnected. This protects the buoy 14 from dangerous wave action and the like that may result from storm or hurricane activity above the surface. This may also protect the buoy 14 from icebergs. Of course, the chains 46 securing the clump weight 44 to the buoy 14 may be sized to hold the buoy 14 deeper or shallower, when disconnected, depending on local area hazards.

Referring back to FIG. 3, to retrieve the buoy 14, the buoy 14 also preferably includes a marker buoy 52 with a retrieval line 54 secured thereto. The marker buoy 52 is preferably secured to the production buoy 14 with an attachment sling 56 and one or more lift lines 58.

Figure 9:
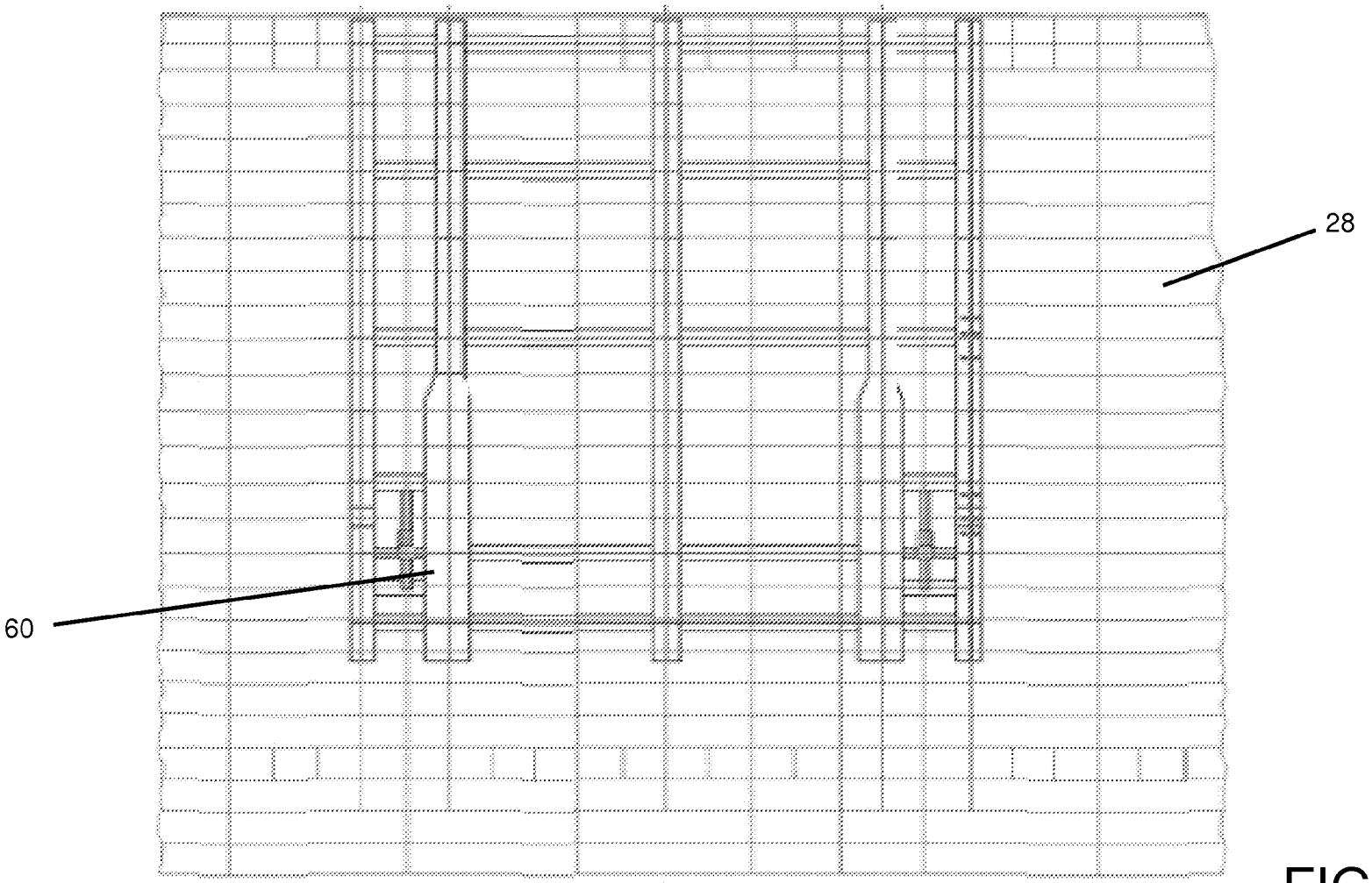
FIG. 9 illustrates a front elevation of a particular embodiment of a support structure of the modular production transfer system utilizing certain aspects of the present inventions.
Figure 10:
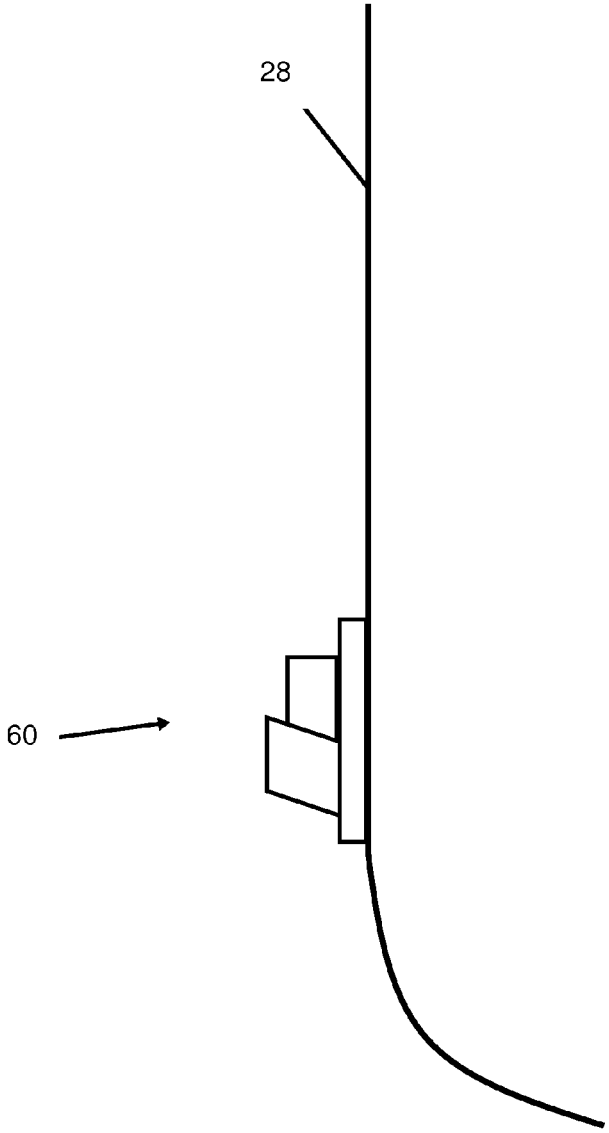
FIG. 10 illustrates side elevation view of a particular embodiment of a support structure utilizing certain aspects of the present inventions.
Figure 11:
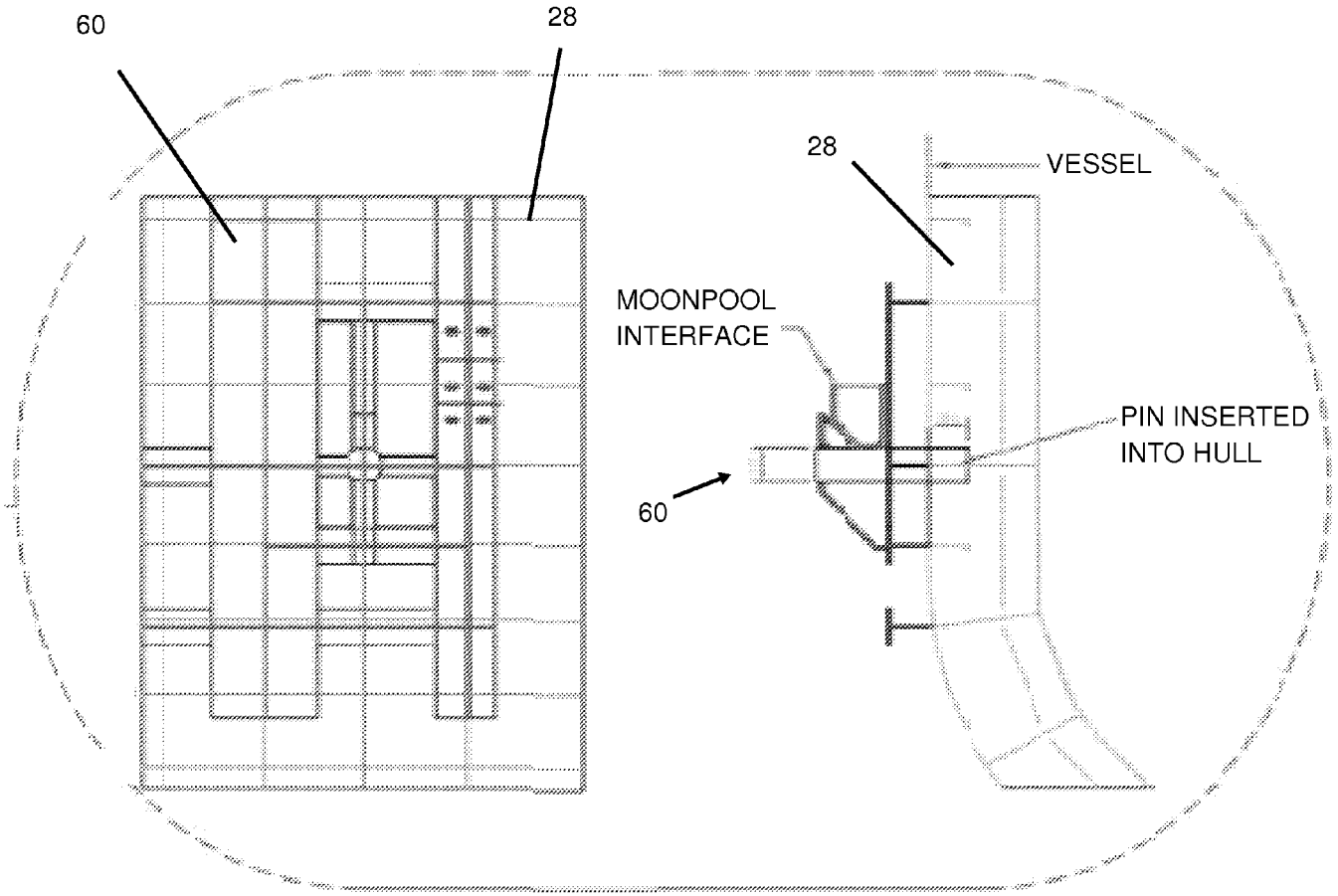
FIG. 11 illustrates a close-up view of portions of a particular embodiment of a support structure utilizing certain aspects of the present inventions.

Referring now to FIGS. 9, 10, and 11, the modular production transfer system 20 may include a support structure 60 configured to be secured to the reinforcement 30 and/or directly to the exterior side of the reinforced outboard sidewall 28. In other embodiments, the support structure 60 itself provides the reinforcement 30 to the exterior side of the reinforced outboard sidewall 28. The support structure 60 may be constructed as an assembly that is then secured to the reinforcement 30 and/or the exterior side of the reinforced outboard sidewall 28. Alternatively, The support structure 60 may be constructed as individual elements that are each secured to the reinforcement 30 and/or the exterior side of the reinforced outboard sidewall 28. In any case, The modular production transfer system 20 is preferably external to the profile of the original vessel. The support structure 60 may be to the reinforcement 30 and/or the exterior side of the reinforced outboard sidewall 28.

Figure 12:
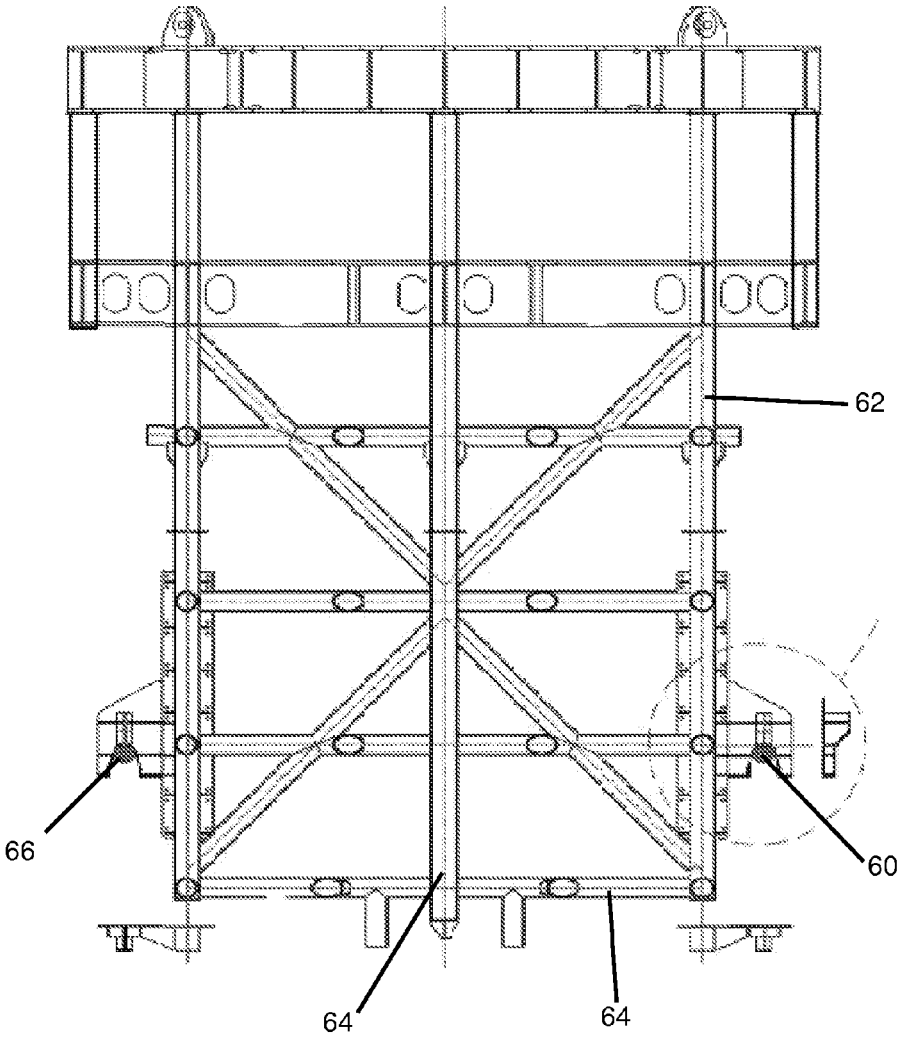
FIG. 12 illustrates a front elevation particular embodiment of a moon pool of the modular production transfer system utilizing certain aspects of the present inventions.
Figure 13:
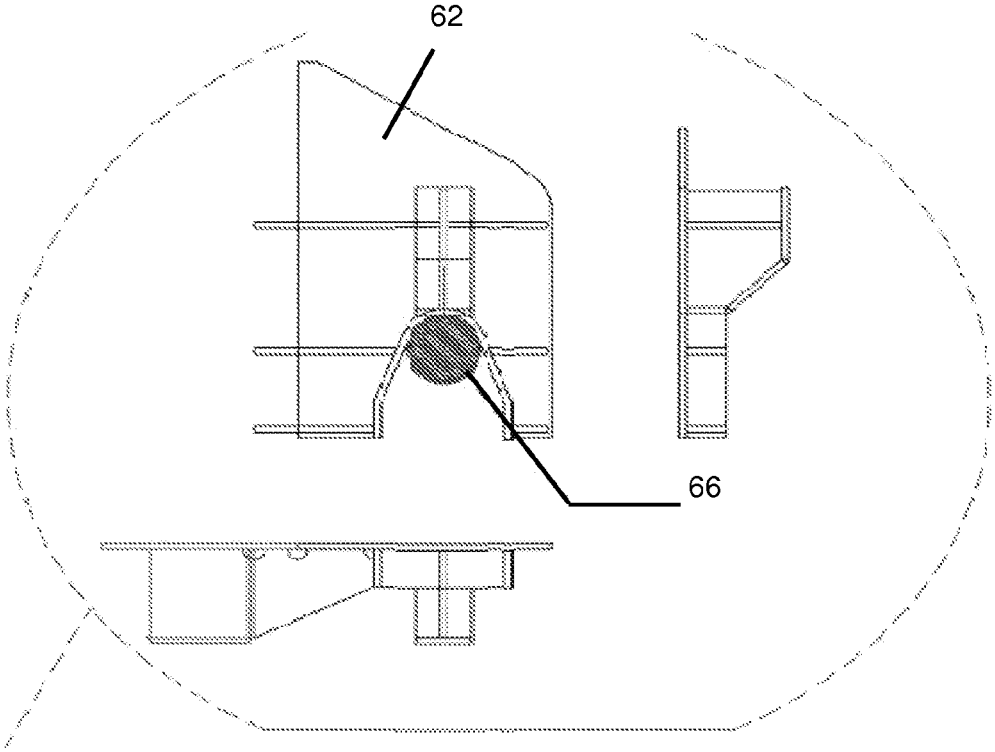
FIG. 13 illustrates a close-up view of a particular embodiment of select connections between the support structure and moon pool utilizing certain aspects of the present inventions.

Referring also to FIG. 12, the modular production transfer system 20 may also include a moon pool 62 secured outboard of the support structure 60. In one embodiment, the moon pool 62 comprises a rectangular lattice of steel support beams 64, providing an interior space to accept the buoy 14. In one embodiment, the moon pool 62 may be rested atop pins 64 protruding from the FPU 12, as shown in FIG. 13. The pins 64 may be secured directly to the exterior side of the reinforced outboard sidewall 28 and/or may form a portion of the support structure 60. The moon pool 62 may be welded to support structure 60.

Figure 14:
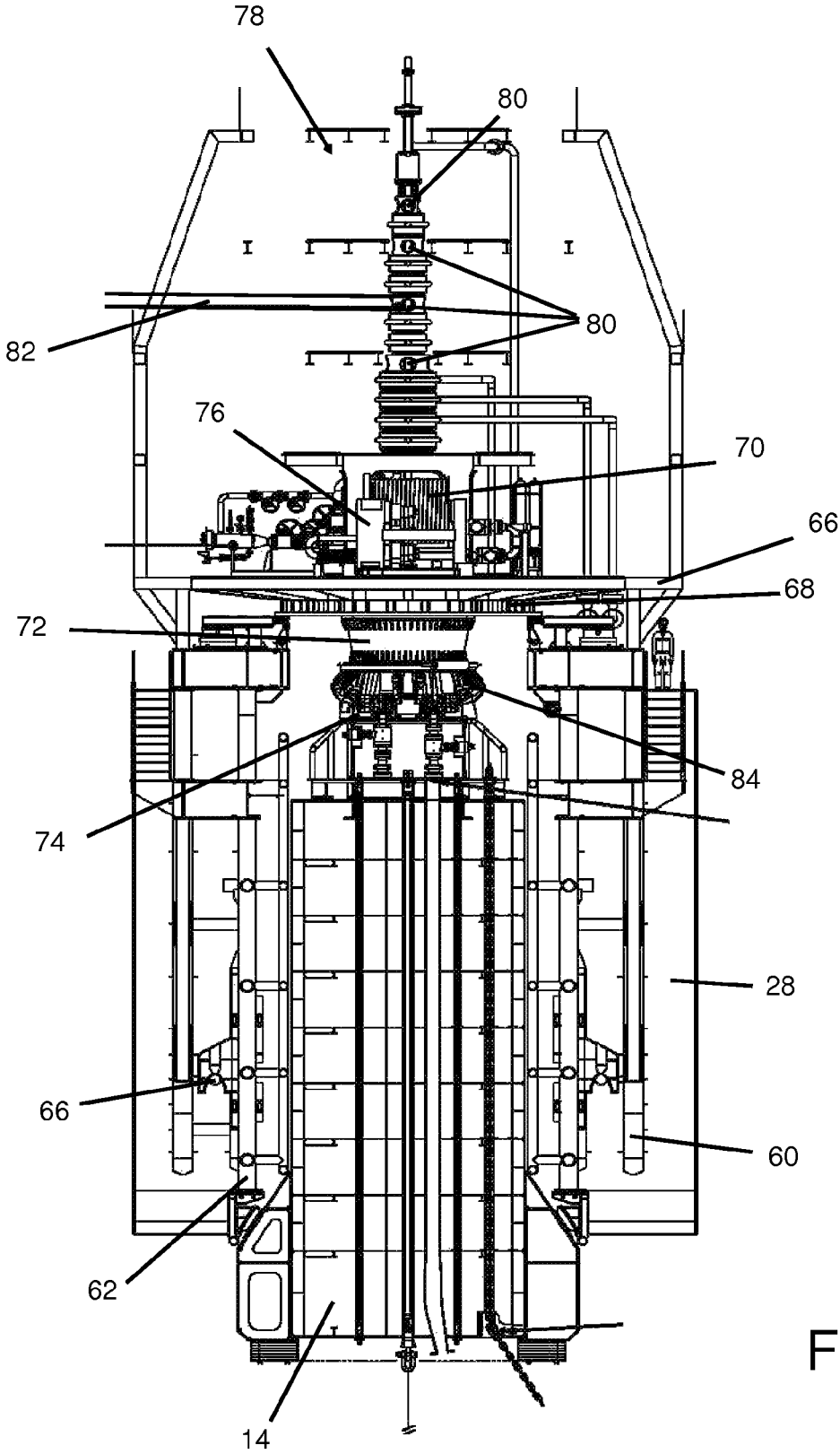
FIG. 14 illustrates a particular embodiment of the modular production transfer system utilizing certain aspects of the present inventions.

Referring now to FIG. 14, the modular production transfer system 20 may also include a inspection platform 66 secured above the moon pool 62. The inspection platform 66 may be welded to the moon pool 62. The inspection platform preferably includes a turntable 68 rotatably secured thereto. The turntable 68 may be rotated by a motor 70 to orient a shipboard connector 72 positioned below the turntable 68. The shipboard connector 72 is configured to mate with and establish fluid communication with a buoy connector 74 atop the buoy 14. The connectors 72,74 preferably establish a plurality of individual fluid communication paths, one for each riser 36, as well as electrical and/or hydraulic connections for the umbilical cables 38. The shipboard connector 72, secured to the turntable 68, is preferably configured to rotate within the moon pool 62, thereby maintain the buoy 14 in a fixed orientation, while the floating production unit 12 rotates about the buoy 14, during production. The modular production transfer system 20 may also include one or more winches 76 secured to the turntable 68 to raise the buoy 14 up and into the moon pool 62 and/or lower the buoy 14 into the water or sea, as will be discussed in greater detail below.

The connectors 72,74 provide a quick connect/disconnect (QC/DC) system between the buoy 14 and the turntable 68. The buoy 14 with the buoy connector or lower portion of the QC/DC system, supports the risers 36, subsea control umbilical cables 38, mooring system 40 and clump weight 44 and may be is parked in the moon pool 62 in a connected, production state and can be released to a pre set water depth when environmental conditions exceed or are anticipated to exceed set limits or to avoid impact from the ice, for example.

In order to facilitate the rotation of the shipboard connector 74, relative to the FPU 12, the modular production transfer system 20 may also include a swivel stalk 78 rigidly secured to the shipboard connector 72. More specifically, the swivel stalk 78, hydraulic power units, and/or lifting machinery 76 is placed within inspection platform 66 and on top of the turntable 68. The turntable 68 is positioned on slew bearing to allow for rotation via the hydraulic or electric motor(s) 70 in order to maintain the buoy 14 geostationary.

The swivel stalk 78 preferably includes a plurality of swivel joints 80, and may include at least one swivel joint 80 for each riser 36. The floating production unit 12 preferably includes production piping 82 rigidly secured to and in fluid communication with the swivel joints 80 and production equipment 32 aboard the floating production unit 12. More specifically, fluid piping 82 is installed between the swivel stalk 78 and the pipe work of the FPU 12 leading to and from the production equipment 32. Electric and communication cabling is also preferably installed between the swivel stalk 78 and a control center of the FPU 12, including slip rings, to allow monitoring and control of the wells 16 and/or pipelines 34 through the umbilical cables 38. In this manner, raw hydrocarbon production is received onboard the FPU 12, separated and other wise processed in the production equipment 32 and then transferred to the pipelines 34.

In a preferred embodiment, the moon pool is configured to contain the buoy 14 such that the buoy connector 72 is above the water during production. Additionally, in the preferred embodiment, the support structure configured to be secured to the exterior side 28 of the floating production unit 12 while the floating production unit 12 is listing, such as when the tank 26 on the opposite side of the FPU 12 from the modular production transfer system 20 is flooded. In this manner the modular production transfer system 20 may be installed on and/or removed from the floating production unit 12 without requiring a dry dock or divers.

There are two variations on the disconnection procedure depending on the status of the vessel. The first is a planned disconnection, which is used when operations require the FPU 12 to disconnect in a calm and orderly manor. The second is an emergency disconnection, which is used when a situation has developed on board the FPU 12, or other uncontrolled factors have arisen and the safety of the FPU 12 is in jeopardy.

Figure 15:
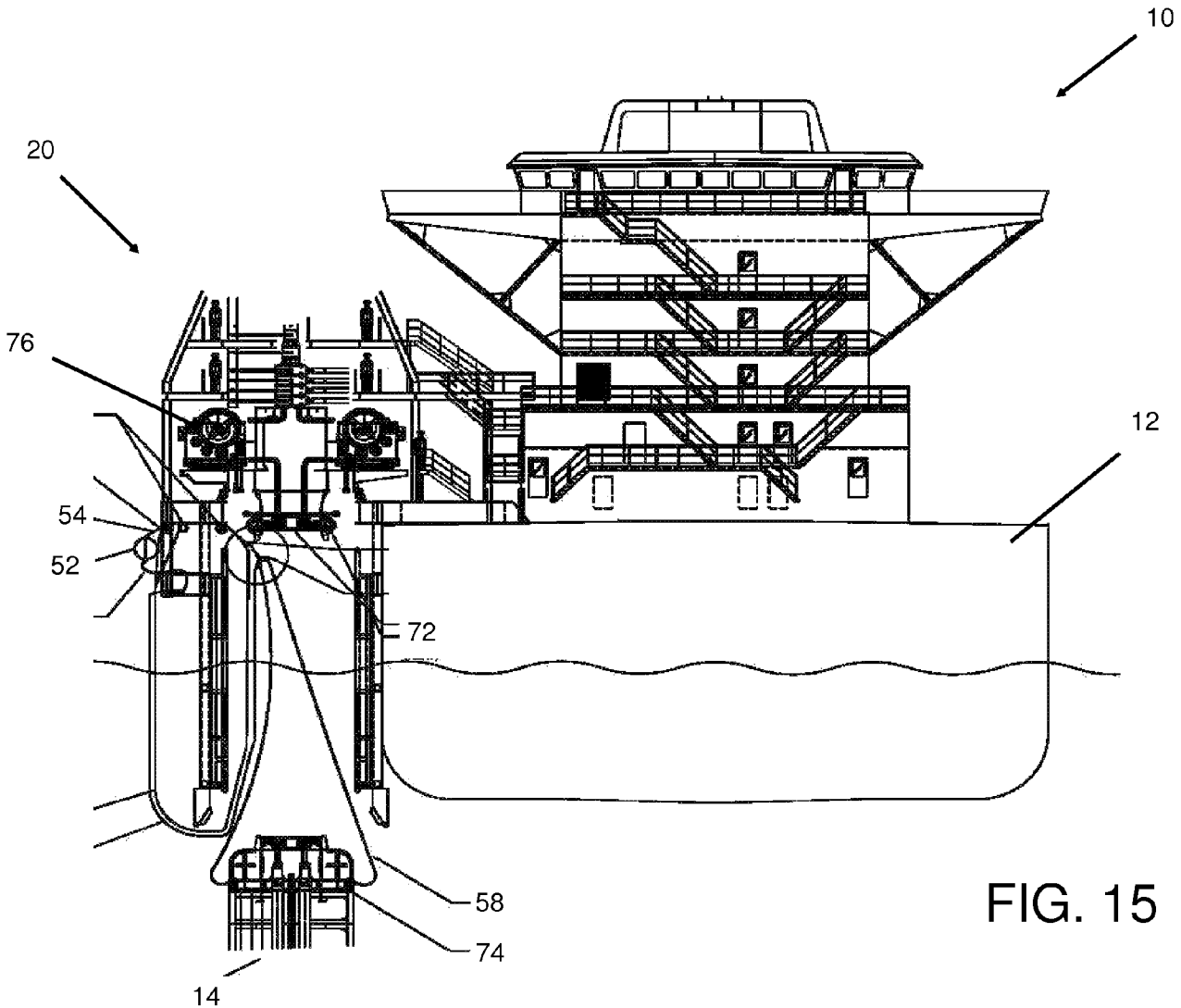
FIG. 15 illustrates a first diagram of a particular connection/disconnection procedure for use with the offshore production system utilizing certain aspects of the present inventions.

The planned disconnection procedure details the sequence of events that are required to transfer the riser buoy 14 from its connected position, to its disconnected position approximately forty meters below the water line, and allow the FPU 12 to leave the area. First, the buoy 14 is depressurized and all isolation valves in the buoy 14, buoy connector 74, and/or shipboard connector 72 are closed. The winches 76 are operated in retrieval mode until the load of the riser buoy 14 is equally shared on the pull-in winches 76. In one specific embodiment, the riser buoy 14 and associated components may weight approximately 250 tons. The load may be displayed on a display within a winch station. The QC/DC clamps 48, which hold the buoy connector 74 mated with the shipboard connector 72, are opened to release the riser buoy 14 from the upper QCDC unit, or shipboard connector 72. As shown in FIG. 15, The winches 76 are then operated in controlled release mode until the riser buoy 14 reaches a depth of approximately forty meters where the clump weight 44 just begins reaching the seabed. When the clump weight 44 rests on the seabed the load will be removed from the lift lines 58 and they will become slack.

The winches 76 will continue to deploy the lift lines 58 until the lift lines 58 are fully deployed. The end of the lift lines 58 are connected to the main pull-in winch 76 through a slot in the winch drum end plates and secured via a pin arrangement. The retrieval line 54 is disconnected from the pin arrangement of the pull-in winch 76 and then attached to the sling 56, this sling 56 is utilized to transfer the lift lines 58 from the pull-in winches 76 to an area close to the endless system in the moon pool 62. They are intended to minimize the risk of dropping a lift line 58 into the sea, during this transfer. One end of the sling 56 is attached to the external moon pool structure, the other is attached to the eye of the lift lines 58. At the outboard endless winch station the marker buoy 52 is attached to the lift lines 58 via the sling 56 and to the retrieval winch. The other end of the marker buoy 52 is attached to one end of retrieval line 54 the other end of the retrieval line 54 is transferred from outboard to inboard via the endless system.

Figure 16:
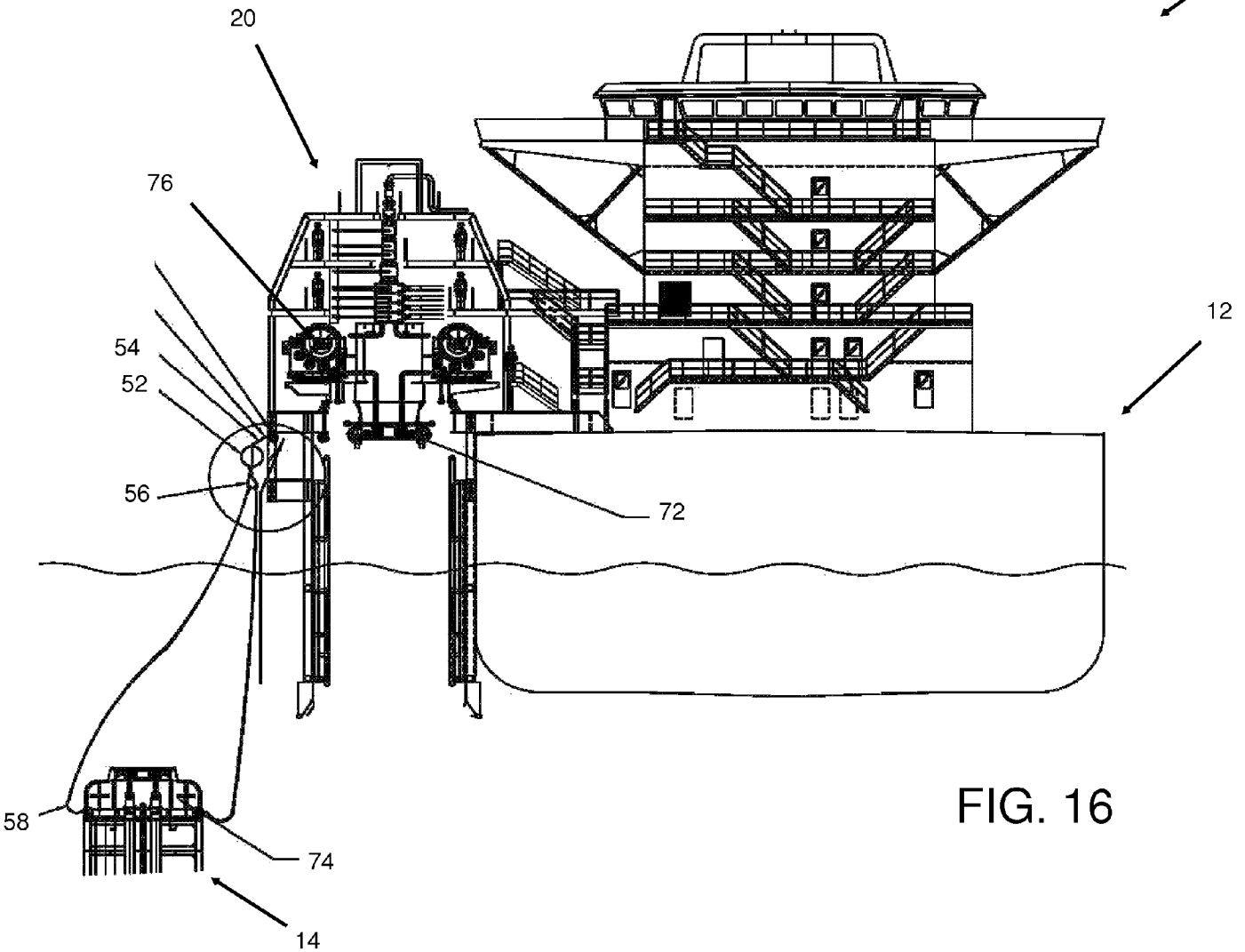
FIG. 16 illustrates a second diagram of a particular connection/disconnection procedure for use with the offshore production system utilizing certain aspects of the present inventions.

Referring also to FIG. 16, during the endless system transfer of the lift lines 58 from inboard to outboard, the marker buoy 52 will remain outboard, attached to the retrieval winch. However, by utilizing a retaining rope the lift lines 58 will remain connected to the marker buoy 52 during the endless system transfer. One end of the retaining rope remains outboard attached to the marker buoy 52; the other end is transferred outboard with the lift lines 58. During this operation the retaining rope will be manually hauled up onto the deck at the outboard endless station. This method is utilized for three reasons: to prevent the marker buoy 52 becoming trapped in the moon pool 62 structure during the endless transfer; in the event of an emergency situation developing, weaker links would fail first followed by the endless sling, leaving the marker buoy 52 attached to the lift lines 58 via the retaining rope; and in the event of an endless system connection failing, the lift lines 58 will remain attached to the marker buoy 52 via the retaining rope.

Figure 17:
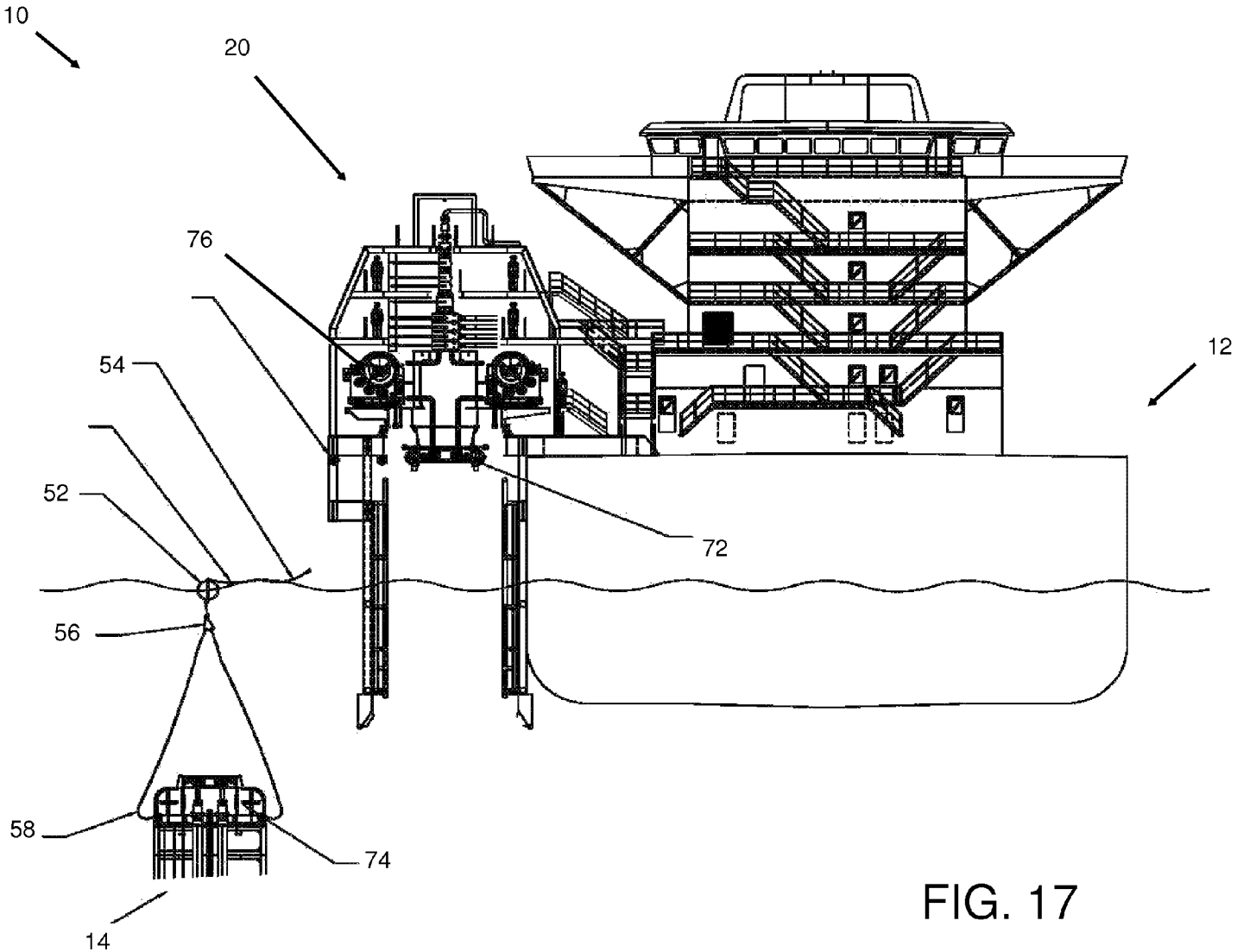
FIG. 17 illustrates a third diagram of a particular connection/disconnection procedure for use with the offshore production system utilizing certain aspects of the present inventions.

The retrieval winch now supports the entire load in the lift lines 58, the sling 56, and the marker buoy 52 with the retrieval line 54 attached. The retrieval winch is now deployed, this will lower the retrieval line 54, marker buoy 52, sling 56 and lift lines 58 into the sea. Once all of the retrieval line 54 has been deployed, the loose end of the retrieval line 54 will be cast into the sea, as shown in FIG. 17. The FPU 12 is now fully detached from the sub sea equipment, and the FPU 12 is safe to leave the area. In the planned disconnected mode the ropes floating on the sea surface may be protected/guarded from potential damage by other vessels. Retrieval and connection of the buoy 14 may be accomplished with a reversal of the above procedure.

The emergency disconnection procedure is utilized when the riser buoy 14 is connected to the FPU 12, and a situation develops, which requires an emergency disconnection. This procedure details the sequence of events that are required to affect an emergency disconnection and transfer the riser buoy 14 to its disconnected position approximately forty meters below the water line. First all valves are closed using the controls on the bridge or in the local station located on the moon pool 62. For example, the QC/DC connector may incorporate five dual ball valve units, built into the lower and upper connectors 72, 74. Then, the QC/DC clamps 48 are released and the riser buoy 14 will begin to free-fall down through the moon pool 62. the chains 50 on the clump weight 44 will slow the buoy's 14 decent as described above.

Thus, the present invention relates to a side mounted fluid transfer system, or modular production transfer system 20, allowing relative rotation between the buoy 14 supporting associated risers 36, subsea control umbilical cables 38 and mooring system 40 and the FPU 12 while maintaining multiple continuous flow paths for fluids from/to the subsea into/from the FPU 12 processing facilities or production equipment 32. The side mounting of the fluid transfer system assembly 20 and associated structures significantly reduces the conversion work required to install and remove the fluid transfer system assembly 20. The buoy 14 may be fabricated using API pipe joints in honeycomb configuration segmented longitudinally to establish compartments and allow for risers 36, subsea control umbilical cables 38, mooring system 40 and clump weight 44 to be installed thereon. The presenting invention also provides a flexible riser monitoring system that can be installed, maintained and removed with an ROV. The present invention thereby provides DP vessels a side mounted fluid transfer system which is modular in design and which can accordingly be readily fitted to a DP vessel side shell without the need for dry dock and can be removed if necessary with minimum effort and cost, so that the vessel can then be used again for its original purpose. Also, provide a buoy design that can be easily fabricated and to support the use of the vessel on multiple fields/applications within a short period of time. Finally, a flexible risers, umbilical cables/hoses and mooring monitoring system design that can be easily built, installed and maintained to allow to support DP vessel operation while connected to the subsea production system.

Select components described above may be similar to components shown in U.S. Patent Application Publication Nos. 20090126616, 20080311804, 20080096448, 20050163572, and/or 20030159581, each of which are incorporated herein by specific reference.

Other and further embodiments utilizing one or more aspects of the inventions described above can be devised without departing from the spirit of Applicant's invention. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A modular production transfer system for use with a floating production unit and a production buoy, the system comprising:

a support structure configured to be secured to an exterior side of the floating production unit;

a moon pool secured outboard of the support structure;

a inspection platform secured above the moon pool;

a turntable secured to the inspection platform;

a winch secured to the turntable; and a shipboard connector positioned below the turntable and configured to mate with a buoy connector on the buoy, wherein the system is configured to suspend the buoy connector above water during production.

2. The system of claim 1, wherein the support structure is configured to be secured to an exterior side of the floating production unit without requiring the floating production unit to be dry docked.

3. The system of claim 2, wherein the support structure is configured to be secured to an exterior side of the floating production unit while the floating production unit is listing.

4. The system of claim 1, wherein the support structure is configured to be secured to an exterior side of the floating production unit without requiring divers.

5. The system of claim 1, wherein the support structure is configured to be removed from the exterior side of the floating production unit without requiring the floating production unit to be dry docked.

6. The system of claim 1, wherein the moon pool is configured to contain the buoy such that the buoy connector is above the water during production.

7. The system of claim 1, wherein the shipboard connector is rotatably secured within the moon pool.

8. The system of claim 7, wherein the buoy rotatably secured within the moon pool during production.

9. The system of claim 7, wherein the shipboard connector is configured to maintain the buoy in a fixed orientation, while the floating production unit rotates about the buoy, during production.

10. The system of claim 7, further including a swivel stalk rigidly secured to the shipboard connector and having a plurality of swivel joints.

11. The system of claim 10, further including production piping rigidly secured to and in fluid communication with the swivel joints and production equipment aboard the floating production unit.

12. The system of claim 10, wherein the swivel joints are aligned vertically along the swivel stalk.

13. An offshore production system comprising:

a floating production unit comprising— an ocean-going dynamically positioned ship, two sponsons, one secured to either side of the ship and each containing at least one tank, at least a portion of an outboard sidewall of one of the sponsons being reinforced, and production equipment secured atop the ship and sponsons, the production equipment configured to separate gas and liquid from raw hydrocarbon production;

a production buoy comprising— at least one production riser configured to transfer the raw hydrocarbon production to the floating production unit, at least one gas export riser configured to transfer gas from the floating production unit, at least one liquid export riser configured to transfer liquid from the floating production unit, and a buoy connector rigidly secured to and in fluid communication with the risers; and a modular production transfer system comprising— a support structure configured to be secured to an exterior side of the reinforced outboard sidewall, a moon pool secured outboard of the support structure, a inspection platform secured above the moon pool, a turntable secured to the inspection platform, a winch secured to the turntable, and a shipboard connector positioned below the turntable and configured to mate with the buoy connector and rotate within the moon pool, thereby maintain the buoy in a fixed orientation, while the floating production unit rotates about the buoy, during production, wherein the moon pool is configured to contain the buoy such that the buoy connector is above the water during production.

14. The system of claim 13, wherein the support structure is configured to be secured to an exterior side of the floating production unit while the floating production unit is listing, thereby not requiring the floating production unit to be dry docked or divers to install the modular production transfer system on the floating production unit and remove the modular production transfer system from the floating production unit.

15. The system of claim 13, further including a swivel stalk rigidly secured to the shipboard connector and having a plurality of swivel joints.

16. The system of claim 15, further including production piping rigidly secured to and in fluid communication with the swivel joints and production equipment aboard the floating production unit.

17. The system of claim 15, wherein the swivel joints are aligned vertically along the swivel stalk.

* * * * *